US008424636B2

(12) United States Patent
Jones et al.

(10) Patent No.: US 8,424,636 B2
(45) Date of Patent: Apr. 23, 2013

(54) MUFFLER ASSEMBLY AND PROCESS OF MANUFACTURE

(75) Inventors: Daniel P. Jones, Royal Oak, MI (US); Philippe Leboeuf, St Maurice (FR); Karl Paul Maurer, North Branch, MN (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/454,207

(22) Filed: Apr. 24, 2012

(65) Prior Publication Data

US 2012/0273299 A1 Nov. 1, 2012

Related U.S. Application Data

(60) Provisional application No. 61/480,763, filed on Apr. 29, 2011.

(51) Int. Cl.
*F01N 13/16* (2010.01)

(52) U.S. Cl.
USPC ..... 181/246; 181/212

(58) Field of Classification Search ..... 181/246
See application file for complete search history.

(56) References Cited

U.S. PATENT DOCUMENTS

| | | | | |
|---|---|---|---|---|
| 4,880,078 | A | 11/1989 | Inoue et al. | |
| 4,993,513 | A | 2/1991 | Inoue et al. | |
| 5,052,513 | A | 10/1991 | Yoshikawa et al. | |
| 5,321,214 | A | 6/1994 | Uegane | |
| 5,340,952 | A * | 8/1994 | Takiguchi | 181/282 |
| 5,468,923 | A * | 11/1995 | Kleyn | 181/282 |
| 5,468,928 | A | 11/1995 | Yelvington | |
| 6,068,082 | A * | 5/2000 | D'Amico et al. | 181/256 |
| 6,543,577 | B1 * | 4/2003 | Ferreira et al. | 181/282 |
| 7,229,937 | B2 | 6/2007 | Bascom et al. | |
| 7,744,693 | B2 | 6/2010 | Mabey | |
| 2004/0188027 | A1 | 9/2004 | Lorocco | |
| 2007/0240932 | A1 | 10/2007 | Van de Flier et al. | |
| 2009/0078499 | A1 * | 3/2009 | Sikes et al. | 181/256 |
| 2009/0194364 | A1 | 8/2009 | Leboeuf | |
| 2010/0029819 | A1 | 2/2010 | Palmer et al. | |
| 2010/0269344 | A1 | 10/2010 | Leboeuf | |
| 2010/0307865 | A1 | 12/2010 | Olsen | |

FOREIGN PATENT DOCUMENTS

| | | |
|---|---|---|
| EP | 0396753 | 8/1990 |
| EP | 0394451 | 10/1990 |
| EP | 0466064 | 7/1994 |

OTHER PUBLICATIONS

International Search Report PCT/us2012/035797, Apr. 30, 2012.
Japan Abstract JP61034310.
Japan Abstract JP610077544.
Japan Abstract JP59155528.
International Search Report PCT/US2012/035809.

* cited by examiner

*Primary Examiner* — Forrest M Phillips

(57) ABSTRACT

A muffler assembly including one or more exhaust pipe(s), a polymeric housing carried by at least one of the exhaust pipe(s); a thermal insulating layer lining the housing interior surface and extending between the housing and exhaust pipe at the housing-exhaust pipe interface; wherein the thermal insulating layer includes a nonwoven fabric; wherein when the fabric is exposed to heat, the fabric increases in thickness to seal the muffler assembly at the housing-exhaust pipe interface and provides thermal insulation to the polymeric housing.

12 Claims, 9 Drawing Sheets

MUFFLER ASSEMBLY AND PROCESS OF MANUFACTURE

CROSS-REFERENCE TO RELATED APPLICATIONS

This application claims priority of U.S. Application No. 61/480,763, filed Apr. 29, 2011.

FIELD OF THE INVENTION

The invention relates to a lightweight polymeric muffler assembly providing improved acoustic properties and ease of manufacture.

BACKGROUND OF THE INVENTION

Exhaust system components of internal combustion and other types of engines are principally designed to reduce the noise exiting the engine with the exhaust gases. A typical exhaust system includes an exhaust pipe to carry exhaust gases and sound away from an engine, and a muffler to attenuate the sound propagated through the exhaust pipe. Mufflers include two general types according to the mode by which noise is attenuated. Reflection mufflers attenuate noise by reflection of sound waves in a series of structures. Mufflers that attenuate noise by absorption of sound waves using absorptive materials such as glass roving are known as dissipative or absorption mufflers.

Reflection mufflers use resonators or changes in exhaust flow direction by labyrinth-like baffling in the muffler. Reflection mufflers usually include a hollow steel housing defining an expansion chamber and one or more baffles and/or resonates chambers in flow communication with the expansion chamber, and inlet and outlet pipes. Sound waves enter and reflect off internal surfaces to cancel each other out and thereby reduce noise.

High temperature of exhaust gas and the corrosive nature of the gas typically have led designers to use metals, particularly steel, in fabrication of mufflers. Corrosion is a problem and has been addressed by using more expensive alloys such as stainless steel or steel alloys. Nevertheless mufflers typically remain bulky and heavy because of the high density of metals.

In effort to reduce the weight of mufflers, polymeric muffler housings with high temperature resistance have been designed, see for instance U.S. Pat. Nos. 5,321,214, 5,340,952 and 5,052,513, 6,543,577 and European Patent 446,064. However, polymeric muffler housings must, in some manner, interface and seal at very hot exhaust pipes. Much attention has been given to the issue of insulating polymeric muffler housings from the very hot exhaust temperatures.

U.S. Pat. No. 7,810,609 teaches an absorption muffler comprising a metallic exhaust pipe including a plurality of perforations, a polymeric housing carried by the exhaust pipe and enclosing the plurality of perforations, and including axially opposed ends. The acoustic insulation is carried between the thermal insulation and the polymeric housing. The muffler comprises flanges to seal the muffler assembly at the interface of the polymeric housing and the exhaust pipe.

U.S. Pat. No. 5,468,923 discloses a polymeric muffler including two halves, each with baffle walls and gas flow openings integrally molded therein. The gas flow openings do not intersect with the mating edges of the baffle walls. The muffler halves are joined along the mating edges of the baffle walls and the outer walls of the two muffler halves.

JP61077544 teaches a silencer material with silencing properties by attaching a viscous elastic body made of synthetic resin to the back of a plate-like non-woven cloth formed of synthetic resin fibers.

JP61034310 discloses a foamed and shaped body to be used as a silencing member by forming a skin layer. The skin layer has higher heat resisting characteristics than that of the foamed part.

US20070240932 teaches composite muffler systems formed of a long fiber thermoplastic. One suitable muffler structure is a multi-piece muffler assembly including at least one long fiber thermoplastic shell section.

EP394451B1 teaches a light-weight muffler having a high noise deadening effect. The outer shell may be a single layer of a thermotropic liquid crystal polyester or of a multiple layer structure comprising a first layer of a thermotropic liquid crystal polyester and a second layer of another structural material such as stainless steel.

US20100269344 discloses a process for making muffler systems wherein the muffler polymeric bodies have a cross section that is constant over the length of the muffler polymeric body.

US20090194364 discloses mufflers having polymeric bodies that are protected from being overheated from the exhaust pipe by having an air gap between the exhaust pipe and the polymeric body.

There is still a need for muffler assemblies having polymeric housings having improved acoustic tuning capabilities, reduction in overall weight, and ease of manufacturing especially addressing the issues of insulating and sealing the polymeric housing at the housing-exhaust pipe or a housing-mounting adapter interface.

SUMMARY OF THE INVENTION

Disclosed is a muffler assembly comprising:

a) one or more exhaust pipe(s), at least one of the exhaust pipe(s) having a plurality of perforations;

b) a polymeric housing carried by at least one of the exhaust pipe(s), the polymeric housing having a housing interior surface and at least one housing-exhaust pipe interface and the polymeric housing enclosing the plurality of perforations to provide one or more acoustic chamber(s); and c) a thermal insulating layer lining said housing interior surface and extending between the housing and exhaust pipe at the at least one housing-exhaust pipe interface; wherein the thermal insulating layer comprises a non-woven fabric comprising crimped, heat-resistant organic fibers compressed thereon, the fibers held in a compressed state by a thermoplastic binder;

wherein when the fabric is exposed to heat, the fabric increases in thickness to seal the muffler assembly at the housing-exhaust pipe interface and provide thermal insulation to the polymeric housing.

Also disclosed is a process for making a polymeric muffler assembly comprising the steps of:

i) assembling one or more exhaust pipe(s), at least one of the exhaust pipe(s) having a plurality of perforations to form a pipe sub-assembly;

ii) enclosing the pipe sub-assembly with two or more polymeric housing sections carried by at least one of the exhaust pipe(s), the polymeric housing sections having a housing interior surface and at least one housing-exhaust pipe interface and the polymeric housing sections enclosing the plurality of perforations to provide one or more acoustic chamber(s); wherein a thermal insulating layer lines said housing interior surface and extends between the housing and exhaust pipe at the at least one housing-exhaust pipe interface, and wherein the thermal insulating layer comprises a nonwoven fabric comprising crimped, heat-resistant organic fibers compressed thereon, the fibers held in a compressed state by a thermoplastic binder;

iii) adhering or attaching the polymeric housing sections together to form a polymeric muffler assembly;

iv) heating the muffler assembly sufficiently such that the reinforced nonwoven fabric increases in thickness to seal the muffler assembly at the housing-exhaust pipe interface and provide thermal insulation to the polymeric housing.

DESCRIPTION OF THE INVENTION

Figure 1:
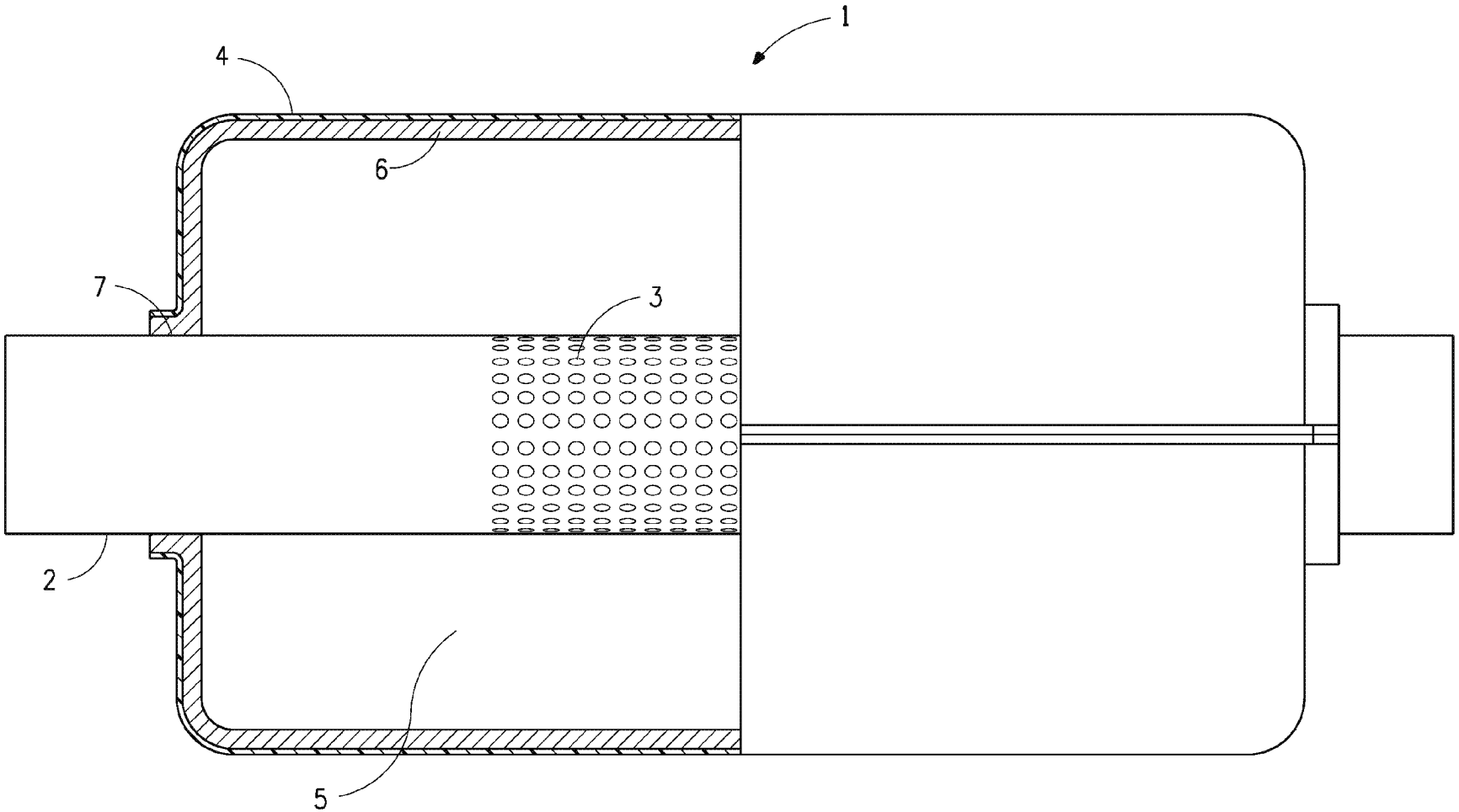
FIG. 1 is a cross-sectional view of a muffler assembly showing the thermal insulating layer sealing at the interface between the polymeric housing and mounting adapter.

By a "muffler assembly" is meant a complete muffler system comprising one or more exhaust pipe(s) having a plurality of perforations and an net and outlet for exhaust gas and; any optional internal components such as baffles and additional pipes; and a polymeric housing. The muffler assembly is reflective muffler assembly, as a result of the one or more acoustic chamber(s) provided by the polymeric housing and optional baffles and pipes.

By "internal baffles" is meant a series of one or more dividing plates used to create two or more acoustic chambers within the muffler assembly. A muffler assembly without any baffles constitutes a single acoustic chamber. A baffle is a partition that directs the exhaust gas flow through the muffler assembly.

Internal components of the muffler assembly include the one or more exhaust pipes, polymeric baffles, metal baffles, metal braces, and any other component enclosed in the polymeric housing.

The term nominal interface refers to one or more regions of the muffler assembly where the polymeric housing would contact the internal components of the muffler assembly; except for the presence of at least one thermal insulating layer between the polymeric housing and the internal components. In preferred embodiments the nominal interface also includes the presence of at least one metal layer.

The exhaust pipe(s), and optional internal components such as baffles and additional pipes, can be configured in any manner desired by the artisan that allows reduction of noise by reflection of the sound waves.

By a "polymeric housing" is meant a housing having a body (casing) made of a polymeric material. The polymeric housing is the outermost part of the muffler assembly and encloses the plurality of perforations of the exhaust pipe(s) as well as any other internal components, to provide one or more acoustic chamber(s). The polymeric housing has a housing interior surface and at least one housing-exhaust pipe interface.

The housing-exhaust pipe interface supports the housing on the one or more exhaust pipe(s) and thus, the exhaust pipe(s) are said "to carry" the polymeric housing. In one embodiment there are two housing-exhaust pipe interfaces supporting the polymeric housing at an exhaust inlet pipe and an exhaust outlet, respectively. There may be other pipes within the muffler assembly that act to direct exhaust gas but do not have a housing-exhaust pipe interface.

A thermal insulating layer lines the housing interior surface. Preferably the thermal insulating layer lines at least 80% of the area of the housing interior surface and more preferably the thermal insulating layer lines substantially the entire housing interior surface.

The thermal insulating layer extends between the housing and exhaust pipe at the housing-exhaust pipe interface. Thus the housing-exhaust pipe interface is a nominal interface. The housing-exhaust pipe interface has one or more thermal insulating layers between the housing and exhaust pipe.

In one embodiment the thermal insulating layer lining the interior surface and extending between the housing and exhaust pipe at the housing-exhaust pipe interface is an integral layer. In another embodiment the thermal insulating layer lining the interior surface is one or more distinct parts, and the thermal insulating layer between the housing and exhaust pipe at the housing-exhaust pipe interface may be one or more distinct part(s). As such, the thermal insulating layers performing the two functions of lining the interior surface and lying between the housing and exhaust pipe at the housing-exhaust pipe interface may be the same material layers or different material layers depending upon the desire of the artisan.

In one embodiment the thermal insulating layer extending between the housing and exhaust pipe at the at least one housing-exhaust pipe interface includes two or more thermal insulating layers. The two or more thermal insulating layers may be provided by any construct desired by the artisan. For instance, additional layers may be added as distinct parts between the housing and exhaust pipe. Folding over a thermal insulating layer to provide a double layer, triple layer, or more layers may be used. A preferred method includes use of an integral thermal insulating layer for both the housing lining and extending between the housing and exhaust pipe interface, and folding over the thermal insulating layer to provide a double layer.

One embodiment of the muffler assembly includes one or more internal polymeric baffle(s) integrally formed and spaced within the polymeric housing and extending toward the exhaust pipe(s) to provide at least one baffle-exhaust pipe interface, the one or more internal polymeric baffle(s) providing two or more acoustic chambers within the muffler assembly. The at least one baffle-exhaust pipe interface may be a nominal interface, as described above. That is, the baffle-exhaust pipe interface may have one or more thermal insulating layers between the baffle and exhaust pipe. The baffle-exhaust pipe interface may be fully or partially sealed to the passage of exhaust gas.

Another embodiment of the muffler assembly includes one or more internal metal baffle(s) connected to and spaced along the exhaust pipe(s) and extending toward the polymeric housing to provide at least one baffle-polymeric housing interface, the one or more internal metal baffle(s) providing two or more acoustic chambers within the muffler assembly. The at least one baffle-polymeric housing interface is a nominal interface, as described above. The baffle-polymeric housing interface may be fully or partially sealed to the passage of exhaust gas.

Another embodiment of the muffler assembly comprising at least two exhaust pipes and two or more metal braces spaced along, attached to, and connecting the at least two exhaust pipes. These braces function to provide vibrational stability to the exhaust pipes.

Another embodiment of the muffler assembly includes a metal layer adjacent to a face of the thermal insulating layer opposite the housing interior surface. The metal layer may provide protection of the thermal insulating layer from soot build-up present in exhaust gases. Preferably the metal layer and the thermal insulating layer extend between the housing and exhaust pipe at the housing-exhaust pipe interface, wherein the metal layer and thermal insulating layer seal the muffler assembly at the housing-exhaust pipe interface. The housing-exhaust pipe interface may have one or more thermal insulating layers and one or more metal layers between the housing and exhaust pipe. Alternatively the metal layer may be absent from the portion of the thermal insulating layer that extends between the housing and exhaust pipe at the housing-exhaust pipe interface.

In one embodiment the metal layer and thermal insulating layer extending between the housing and exhaust pipe at the at least one housing-exhaust pipe interface includes two or more metal layers and two or more thermal insulating layers. The two or more metal layers and thermal insulating layers may be provided by any construct desired by the artisan. For instance, additional layers may be added as distinct parts between the housing and exhaust pipe. Folding over a metal layer and thermal insulating layer to provide a double layer, triple layer, or more layers may be used.

In one embodiment the metal layer and there insulating layer are attached to each other to provide a laminate having a thermal insulating face and a metal face. The thermal insulating face is positioned adjacent the polymeric housing interior surface.

Exhaust pipes may be made of any materials capable of withstanding the typical temperatures of internal combustion engines. The exhaust pipe(s), and optional internal components, can be made from a high melting temperature thermoplastic polymer, a thermoset polymer, an infusible polymer, or a metal or metal alloy such as titanium, steel, aluminum, aluminized steel, or stainless steel. Preferably the exhaust pipes and mounting adapters are made of metal or metal alloy.

The polymeric housing may be made of any kind of polymer, including a thermoplastic, thermoset, or an infusible polymer. The polymeric material may comprise any other materials usually found in such compositions such as fillers, reinforcing agents, stabilizers, pigments, antioxidants, and lubricants. It includes both thermoset and thermoplastic polymeric materials.

The polymer used in the manufacture of the polymeric housing, baffles, or pipes should be temperature resistant enough to withstand temperatures that it may be heated to by the exhaust gases. Useful materials for these polymeric housings include thermoplastics selected from the group consisting of semi-crystalline polyamides, thermotropic liquid crystalline polymers, polyesters, polyacetals, and thermosetting resins selected from the group consisting of epoxy, melamine and phenolic resins, and infusible polymers selected from the group consisting of polyimides, poly(p-phenylenes), and polymers comprising greater than 50% repeat units the formula

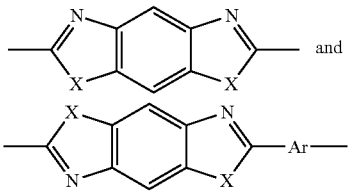

wherein X is NH, N-Phenyl, O (oxygen) or S (sulfur), and Ar is p-phenylene, 4,4'-biphenylene or 1,4-naphthylylene. The polymeric muffler housing must be capable of withstanding the high exhaust temperatures to which it may be exposed, for example by direct contact with exhaust gases and/or being heated by thermal conduction.

Preferred polymers for the polymeric housing are thermoplastic polymers. Preferred thermoplastics are polyamides, especially partially aromatic polyamides referred to as semi-aromatic polyamides.

The semi-aromatic polyamide is a homopolymer, a copolymer, a terpolymer or more advanced polymers formed from monomers containing aromatic groups. One or more aromatic carboxylic acids may be terephthalate or a mixture of terephthalate with one or more other carboxylic acids, such as isophthalic acid, phthalic acid, 2-methyl terephthalic acid and naphthalic acid. In addition, the one or more aromatic carboxylic acids may be mixed with one or more aliphatic dicarboxylic acids, as disclosed above.

Preferred polyamides disclosed herein are homopolymers or copolymers wherein the term copolymer refers to polyamides that have two or more amide and/or diamide molecular repeat units. The homopolymers and copolymers are identified by their respective repeat units. For copolymers disclosed herein, the repeat units are listed in decreasing order of mole % repeat units present in the copolymer. The following list exemplifies the abbreviations used to identify monomers and repeat units in the homopolymer and copolymer polyamides (PA):

HMD hexamethylene diamine (or 6 when used in combination with a diacid)
T Terephthalic acid
AA Adipic acid
DMD Decamethylenediamine
6 € -Caprolactam
DDA Decanedioic acid
DDDA Dodecanedioic acid
I Isophthalic acid
MXD meta-xylylene diamine
TMD 1,4-tetramethylene diamine
4T polymer repeat unit formed from TMD and T
6T polymer repeat unit formed from HMD and T
DT polymer repeat unit formed from 2-MPMD and T
MXD6 polymer repeat unit formed from MXD and AA 66 polymer repeat unit formed from HMD and AA
10T polymer repeat unit formed from DMD and T
410 polymer repeat unit formed from TMD and DDA
510 polymer repeat unit formed from 1,5-pentanediamine and DDA
610 polymer repeat unit formed from HMD and DDA
612 polymer repeat unit formed from HMD and DDDA
6 polymer repeat unit formed from € -caprolactam
11 polymer repeat unit formed from 11-aminoundecanoic acid
12 polymer repeat unit formed from 12-aminododecanoic acid Note that in the art the term "6" when used alone designates a polymer repeat unit formed from € -caprolactam. Alternatively "6" when used in combination with a diacid such as T, for instance 6T, the "6" refers to HMD. In repeat units comprising a diamine and diacid, the diamine is designated first. Furthermore, when "6" is used in combination with a diamine, for instance 66, the first "6" refers to the diamine HMD, and the second "6" refers to adipic acid. Likewise, repeat units derived from other amino acids or lactams are designated as single numbers designating the number of carbon atoms.

Preferred polyamides useful in the invention are selected from the group consisting of:

Group (III) Polyamides having said melting point of at least 210° C., and comprising (a) about 20 to about 35 mole percent semiaromatic repeat units derived from monomers selected from one or more of the group consisting of:
  i) aromatic dicarboxylic acids having 8 to 20 carbon atoms and aliphatic diamines having 4 to 20 carbon atoms; and
(b) about 65 to about 80 mole percent aliphatic repeat units derived from monomers selected from one or more of the group consisting of:
  ii) an aliphatic dicarboxylic acid having 6 to 20 carbon atoms and said aliphatic diamine having 4 to 20 carbon atoms; and
  iii) a lactam and/or aminocarboxylic acid having 4 to 20 carbon atoms;

Group (IV) Polyamides comprising (cc) about 50 to about 95 mole percent semiaromatic repeat units derived from monomers selected from one or more of the group consisting of:
  (i) aromatic dicarboxylic acids having 8 to 20 carbon atoms and aliphatic diamines having 4 to 20 carbon atoms; and
(dd) about 5 to about 50 mole percent aliphatic repeat units derived from monomers selected from one or more of the group consisting of:
(ii) an aliphatic dicarboxylic acid having 6 to 20 carbon atoms and said aliphatic diamine having 4 to 20 carbon atoms; and
(iii) a lactam and/or aminocarboxylic acid having 4 to 20 carbon atoms; and Group (V) Polyamides having said melting point of at least 260° C., and comprising (ee) greater than 95 mole percent semiaromatic repeat units derived from monomers selected from one or more of the group consisting of:
  (i) aromatic dicarboxylic acids having 8 to 20 carbon atoms and aliphatic diamines having 4 to 20 carbon atoms; and
(ff) less than 5 mole percent aliphatic repeat units derived from monomers selected from one or more of the group consisting of:
  (ii) an aliphatic dicarboxylic acid having 6 to 20 carbon atoms and said aliphatic diamine having 4 to 20 carbon atoms;
  (iii) a lactam and/or aminocarboxylic acid having 4 to 20 carbon atoms.

Preferred Group (III) to Group (V) Polyamides are those that have at least about 60 meq/Kg of amine ends, and preferably at least 70 meq/Kg amine ends. Amine ends may be determined by titrating a 2 percent solution of polyimide in a phenol/methanol/water mixture (50:25:25 by volume) with 0.1 N hydrochloric acid. The end point may be determined potentiometrically or conductometrically (See Kahan, M. I. Ed. *Nylon Plastics Handbook*, Hanser: Munich, 1995; p. 79 and Waltz, J. E. and Taylor, G. B., *Anal. Chem.* 1947 19, 448-50).

Other preferred polyamides of Group (III) Polyamides have a melting point of at least 260° C., as determined with differential scanning calorimetry at 10° C./min, and are selected from the group consisting of poly(tetramethylene hexanediamide/tetramethylene terephthalamide) (PA46/4T), poly(tetramethylene hexanediamide/hexamethylene terephthalamide) (PA46/6T), poly(tetramethylene hexanediamide/2-methylpentamethylene hexanediamide/decamethylene terephthalamide) PA46/D6/10T), poly(hexamethylene hexanediamide/hexamethylene terephthalamide) (PA 66/6T), poly(hexamethylene hexanediamide/hexamethylene isophthalamide/hexamethylene terephthalamide PA66/6I/6T, and poly(hexamethylene hexanediamide/2-methylpentamethylene hexanediamide/hexamethylene terephthalamide (PA66/D6/6T). A most preferred polyamide is PA 66/6T.

Preferred Group (IV) Polyamides are selected from the group consisting of poly(tetramethylene terephthalamide/hexamethylene hexanediamide) (PA4T/66), poly(tetramethylene terephthalamide/ϵ-caprolactam) (PA4T/6), poly(tetramethylene terephthalamide/hexamethylene dodecanediamide) (PA4T/612), poly(tetramethylene terephthalamide/2-methylpentamethylene hexanediamide/hexamethylene hexanediamide) (PA4T/D6/66), poly(hexamethylene terephthalamide/2-methylpentamethylene terephthalamide/hexamethylene hexanediamide) (PA6T/DT/66), poly(hexamethylene terephthalamide/hexamethylene hexanediamide) PA6T/66, poly(hexamethylene terephthalamide/hexamethylene decanediamide) (PA6T/610), poly(hexamethylene terephthalamide/hexamethylene tetradecanediamide) (PA6T/614) poly(nonamethylene terephthalamide/nonamethylene decanediamide) (PA9T/910), poly (nonamethylene terephthalamide/nonamethylene dodecanediamide) (PA9T/912), poly(nonamethylene terephthalamide/11-aminoundecanamide) (PA9T/11), poly(nonamethylene terephthalamide/12-aminododecanamide) (PA9T/12), poly(decamethylene terephthalamide/11-aminoundecanamide) (PA 10T/11), poly(decamethylene terephthalamide/12-aminododecanamide) (PA10T/12) poly(decamethylene terephthalamide/decamethylene decanediamide) (PA10T/1010), poly(decamethylene terephthalamide/decamethylene dodecanediamide) (PA10T/1012), poly(decamethylene terephthalamide/tetramethylene hexanediamide) (PA10T/46), poly(decamethylene terephthalamide/ϵ-caprolactam) (PA10T/6), poly(decamethylene terephthalamide/hexamethylene hexanediamide) (PA10T/66), poly(dodecamethylene terephthalamide/dodecamethylene dodecanediamide) (PA12T/1212) poly(dodecamethylene terephthalamide/c-caprolactam) (PA12T/6), and poly (dodecamethylene terephthalamide/hexamethylene hexanediamide) (PA12T/66); and a most preferred Group (IV) Polyamide is PA6T/66.

Preferred Group (V) Polyamides are selected from the group consisting of poly(tetramethylene terephthalamide/2-methylpentamethylene terephthalamide) PA4T/DT, poly(tetramethylene terephthalamide/hexamethylene terephthalamide) PA4T/6T, poly(tetramethylene terephthalamide/decamethylene terephthalamide) PA4T/10T, poly(tetramethylene terephthalamide/dodecamethylene terephthalamide) PA4T/12T, poly(tetramethylene terephthalamide/2-methylpentamethylene terephthalamide/hexamethylene terephthalamide) (PA4T/DT/6T), poly(tetramethylene terephthalamide/hexamethylene terephthalamide/2-methylpentamethylene terephthalamide) (PA4T/6T/DT), poly(hexamethylene terephthalamide/2-methylpentamethylene terephthalamide) (PA6T/DT), poly(hexamethylene hexanediamide/hexamethylene isophthalamide) (PA 6T/6I), poly(hexamethylene terephthalamide/decamethylene terephthalamide) PA6T/10T, poly(hexamethylene terephthalamide/dodecamethylene terephthalamide) (PA6T/12T), poly(hexamethylene terephthalamide/2-methylpentamethylene terephthalamide/poly(decamethylene terephthalamide) (PA6T/DT/10T), poly(hexamethylene terephthalamide/decamethylene terephthalamide/dodecamethylene terephthalamide) (PA6T/10T/12T), poly(decamethylene terephthalamide) (PA10T), poly(decamethylene terephthalamide/tetramethylene terephthalamide) (PA10T/4T), poly(decamethylene terephthalamide/2-methylpentamethylene terephthalamide) (PA10T/DT), poly(decamethylene terephthalamide/dodecamethylene terephthalamide) (PA10T/12T), poly(decamethylene terephthalamide/2-methylpentamethylene terephthalamide/(decamethylene terephthalamide) (PA10T/DT/12T). poly(dodecamethylene terephthalamide) (PA12T), poly(dodecamethylene terephthalamide)/tetramethylene terephthalamide) (PA12T/4T), poly(dodecamethylene terephthalamide)/hexamethylene terephthalamide) PA12T/6T, poly(dodecamethylene terephthalamide)/decamethylene terephthalamide) (PA12T/10T), and poly(dodecamethylene terephthalamide)/2-methylpentamethylene terephthalamide) (PA12T/DT); and a most preferred Group (V) Polyamide is PA6T/DT.

Preferably polymeric housings are molded or extruded thermoplastic articles comprising a thermoplastic composition comprising (a) a thermoplastic resin selected from the group consisting of Group (III)-(V) polyamides, and mixtures thereof;

(b) 0.25 to 15 weight percent of one or more polyhydric alcohols having more than two hydroxyl groups and a having a number average molecular weight ($M_n$) of less than 2000, for instance, those selected from the group consisting of pentaerythritol, dipentaerythritol, tripentaerythritol, di-trimethylolpropane, D-mannitol, D-sorbitol and xylitol;

(c) 10 to about 60 weight percent of one or more reinforcement agents, for instance, selected from the group consisting calcium carbonate, glass fibers with circular and noncircular cross-section, glass flakes, glass beads, carbon fibers, talc, mica, wollastonite, calcined clay, kaolin, diatomite, magnesium sulfate, magnesium silicate, barium sulfate, titanium dioxide, sodium aluminum carbonate, barium ferrite, potassium titanate and mixtures thereof; and (d) 0 to 50 weight percent of a polymeric toughener comprising a reactive functional group and/or a metal salt of a carboxylic acids elected from the group consisting of: a copolymer of ethylene, glycidyl (meth)acrylate, and optionally one or more (meth)acrylate esters; an ethylene/α-olefin or ethylene/α-olefin/diene copolymer grafted with an unsaturated carboxylic anhydride; a copolymer of ethylene, 2-isocyanatoethyl (meth)acrylate, and optionally one or more (meth)acrylate esters; and a copolymer of ethylene and acrylic acid reacted with a Zn, Li Mg or Mn compound to form the corresponding iononier;

wherein all weight percentages are based on the total weight of the thermoplastic composition. Such compositions are fully disclosed in US patent publication 2010/0029819 A1, published Feb. 4, 2010, and hereby incorporated by reference.

The thermal insulating layer comprises a nonwoven fabric comprising crimped, heat-resistant organic fibers compressed thereon, the fibers held in a compressed state by a thermoplastic binder, a detailed description of which is disclosed in U.S. Pat. No. 7,229,937, hereby incorporated by reference.

When exposed to heat the nonwoven fabric is capable of increasing its thickness by at least three times, and preferably at least five times. When exposed to heat the binder in the reinforced nonwoven fabric softens and flows, releasing the restrained crimped fibers and allowing the thickness of the fabric to increase dramatically. This increase in thickness allows the thermal insulating layer lying between the housing and the exhaust pipe interface to seal the interface.

The nonwoven fabric useful in the invention has only enough entanglement of the heat-resistant organic fibers to manufacture a lightweight web. No additional energy is imparted to the web to entangle the fibers with each other. A thermoplastic binder is added to the heat-resistant organic fibers during manufacturing of the nonwoven mat. The thermoplastic binder can be a thermoplastic fiberous material. The lightweight web may be laminated to a reinforcing scrim, a metal layer, or any other layer desired by the artisan, by heating and compressing the combination and then cooling the combination to set the structure while the crimped fibers are compressed and restrained. By compressing the lightweight web in this manner, when the binder material is softened or melts, the heat-resistant organic fibers in the sheet are free to return to a formally lightweight lofty state similar to the one they had prior to compression.

The thickness of the nonwoven fabric increases by at least three times when exposed to high heat or flame. Generally, as the temperature is increased, the rate of bulking is increased and the amount of bulking increases also, and thickness increases of greater than 25 times the compressed thickness have been seen. It is believed that temperatures as low as 150 centigrade are needed to initiate the bulking effect, and it is believed that starting at temperatures of about 225 centigrade the bulking action proceeds immediately.

The compressed reinforced nonwoven fabrics preferably have an overall thickness of 0.025 to 0.12 centimeters (0.010 to 0.050 inches). Such fabrics also preferably have a basis weight in the range of 20 to 136 g/m$^2$ (0.6 to 4 oz/yd$^2$). In one embodiment a reinforcing scrim component is present preferably making up 3.4 to 34 g/m$^2$ (0.1 to 1.0 oz/yd$^2$) and the fibrous web component preferably ranging from 1.7 to 102 g/m$^2$ (0.5 to 3.0 oz/yd$^2$).

The reinforced nonwoven fabric comprises crimped heat-resistant organic fibers. Such crimped fibers are preferably staple fibers that have cut lengths in the range of 0.4 to 2.5 inches (1 to 6.3 cm) preferably 0.75 to 2 inches (1.9 to 5.1 cm) and preferably have 2 to 5 crimps per centimeter (5 to 12 crimps per inch). By "heat resistant fiber" it is meant that the fiber preferably retains 90 percent of its fiber weight when heated in air to 500° C. at a rate of 20° C. per minute.

Heat resistant staple fibers useful in the reinforced nonwoven fabric include fiber made from para-aramid, polybenzazole, polybenzimidazole, and polyimide polymer. The preferred heat resistant fiber is made from aramid polymer, especially para-aramid polymer.

As used herein, "aramid" is meant a polyamide wherein at least 85% of the amide (—CONH—) linkages are attached directly to two aromatic rings. "Para-aramid" means the two rings or radicals are para oriented with respect to each other along the molecular chain. Additives can be used with the aramid. In fact, it has been found that up to as much as 10 percent, by weight, of other polymeric material: can be blended with the aramid or that copolymers can be used having as much as 10 percent of other diamine substituted for the diamine of the aramid or as much as 10 percent of other diacid chloride substituted for the diacid chloride of the aramid. In the practice of this invention, the preferred para-aramid is poly(paraphenylene terephthalamide). Methods for making para-aramid fibers are disclosed in U.S. Pat. Nos. 3,869,430, 3,869,429, and 3,767,756. Such aromatic polyimide organic fibers and various forms of these fibers are available from DuPont Company, Wilmington, Del. under the trademark KEVLAR® fibers.

Commercially available polybenzazole fibers include ZYLON PBO-AS (Poly(p-phenylene-2,6-benzobisoxazole) fiber, ZYLON® PBO-HM (Poly(p-phenylene-2,6-benzobisoxazole)) fiber, available from Toyobo, Japan. Commercially available polybenzimidazole fibers include PBI® fiber available from Celanese Acetate LLC. Commercially available polyimide fibers include P-84® fiber available from LaPlace Chemical.

The crimped organic fibers are held in place with up to 30 parts by weight binder material. A preferred binder material is a combination of binder fiber and binder powder that is activated by the application of heat. Binder fibers are typically made from a thermoplastic material that flows at a temperature that is lower (i.e., has a softening point lower) than the softening point of any of the other staple fibers in the fiber blend. Sheath/core bicomponent fibers are preferred as binder fibers, especially bicomponent binder fibers having a core of polyester homopolymer and a sheath of copolyester that is a binder material, such as are commonly available from Unitika Co., Japan (e.g., sold under the trademark MELTY® fiber). Useful types of binder fibers can include those made from polypropylene, polyethylene, or polyester polymers or copolymers, the fibers containing only that polymer or copolymer, or as a bicomponent fiber in side-by-side or sheath/core configuration. Preferably the binder fibers are present in an amount of up to 20 percent of the reinforced nonwoven fabric. Binder powder is preferably present in an amount of up to 30 percent of the reinforced nonwoven fabric. The preferred binder powder is a thermoplastic binder powder such as copolyester Griltex EMS 6E adhesive powder.

The nonwoven fabric may contain an open mesh scrim to provide some reinforcement. Such scrims preferably have a basis weight in the range of 3.4 to 34 g/m$^2$ (0.1 to 1.0 oz/yd$^2$) and are referred to as an "open mesh" scrim because these scrims have only 0.8 to 6 ends per centimeter (2 to 15 ends per inch). The most preferred open mesh scrims have a basis weight in the range of 6.8 to 17 g/m$^2$ (0.2 to 0.5 oz/yd$^2$) and have preferably 1 to 4 ends per centimeter (3 to 10 ends per inch), in both the warp and fill direction. Preferably, the mesh is made by binding together two sets of cross-plied polyester continuous filaments or continuous filament yarns that have a binder coating. Representative open mesh scrims are available from Saint-Gobain Technical Fabrics of Niagara Falls, N.Y. under the name of BAYEX® Scrim Fabrics.

The process for making a reinforced nonwoven fabric that bulks in heat, comprises the steps of: a) forming a mat comprising crimped heat-resistant organic fiber and binder fiber, b) optionally applying binder powder to the fabric assembly, c) heating the fabric assembly to activate the binder fiber and binder powder, d) compressing the fabric assembly to a compressed state, and e) cooling the fabric assembly in a compressed state to form a nonwoven fabric. If a reinforcing scrim, metal layer or other functional layer is desired, it may be laminated to the fabric assembly during the heating step. In a preferred embodiment the mat comprising crimped heat-resistant organic fiber is laminated to a metal layer.

The mat may be formed by any method that can create low-density webs. For example, dumps of crimped staple fibers and binder fibers obtained from bales of fiber can be opened by a device such as a picker. Preferably these fibers are staple fibers having a linear density of about 0.55 to about 110 dtex per filament (0.5 to 100 denier per filament), preferably 0.88 to 56 dtex/filament (0.8 to 50 denier/filament) with the linear density range of about 1 to 33 dtex/filament (0.9 to 30 denier/filament) being most preferred.

The opened fiber mixture can be then blended by any available method, such as air conveying, to form a more uniform mixture. Alternatively, the fibers can be blended to form a uniform mixture prior to fiber opening in the picker. The blend of fibers can then be converted into a fibrous web by use of a device such as a card, although other methods, such as air-laying of the fibers may be used. It is preferable that the fibrous web be used directly from the card without any cross-lapping. However, if desired the fibrous web can then be sent via conveyor to a device such as a cross lapper to create a cross lapped structure by layering individual webs on top of one another in a zig-zig structure.

Fibrous webs from one or more cards and optional functional layers such as a reinforcing scrim or metal layer can then be collected on a transporting belt. Additional webs can be laid on either of the one or two web structures if needed. Optionally, binder powder may be applied to the combined webs in a preferred amount of about 3.4 to 24 g/m$^2$ (0.1 to 0.7 oz/yd$^2$). The combined webs, optional binder powder, and optional functional layer(s) are then conveyed through an oven at a temperature sufficient to soften and partially melt the binder fiber and powder and allow it to adhere the fibers together. At the oven exit the sheet is preferably compressed between two steel rolls to consolidate the layers into a cohesive fabric. The fabric is then cooled in this compressed state.

Suitable nonwoven fabric useful as a thermal insulating layer in the invention is available under the Trademark NOMEX® ON DEMAND fabric from E.I. DuPont de Nemours and Company, Wilmington, Del., USA.

A preferred embodiment of the muffler assembly includes a metal layer adjacent to a face of the thermal insulating layer opposite the housing interior surface. The metal layer acts to protect the thermal insulating layer and prevents excessive build-up of soot from the exhaust gas. The metal layer may be a metal foil. The metal layer may be a self supporting metal layer. The metal layer may be attached to the thermal insulating layer. The metal layer may be attached to the polymeric housing at one or more points. The metal layer may be attached to the one or more exhaust pipe(s). Preferably the metal layer is a foil having a thickness of 0.1 mm to about 0.01 mm, and preferably about 0.5 mm to about 0.02 mm. The metal layer may be selected from the group consisting of steel, aluminum, aluminized steel, titanium, and metal alloys of steel.

Manufacturing of Muffler Assembly

Another embodiment is a process for making a muffler assembly comprising the steps of:

i) assembling one or more exhaust pipe(s), at least one of the exhaust pipe(s) having a plurality of perforations to form a pipe sub-assembly;

ii) enclosing the pipe sub-assembly with two or more polymeric housing sections carried by at least one of the exhaust pipe(s), the polymeric housing sections having a housing interior surface and at least one housing-exhaust pipe interface and the polymeric housing sections enclosing the plurality of perforations to provide one or more acoustic chamber(s); wherein a thermal insulating layer lines said housing interior surface and extends between the housing and exhaust pipe at the at least one housing-exhaust pipe interface, and wherein the thermal insulating layer comprises a nonwoven fabric comprising crimped, heat-resistant organic fibers compressed thereon, the fibers held in a compressed state by a thermoplastic binder;

iii) adhering or attaching the polymeric housing sections together to form a polymeric muffler assembly;

iv) heating the muffler assembly sufficiently such that the nonwoven fabric increases in thickness to seal the muffler assembly at the housing-exhaust pipe interface and provide thermal insulation to the polymeric housing.

All the various embodiments of the muffler assembly disclosed above also are applicable to the various embodiment of the process for making the muffler assembly.

Assembling a sub-assembly, including one or more pipes and optional metal baffle, can be accomplished according to known techniques available to the artisan.

Enclosing the pipe sub-assembly may include use of a polymeric housing, optionally comprising polymeric baffles as disclosed above, and including two, three or more sections. The interior surfaces of the polymeric housing sections are fitted with the thermal insulating layer and optionally with a metal layer, as disclosed above. These layers can be affixed to the housing any means available to the artisan. The insulating layer and/or metal layer may overlap with that of an adjacent section by allowing the insulating layer and/or metal layer to extend beyond the perimeter of the polymeric housing sections.

Adhering or attaching the polymeric housing sections fitted with the additional layers is accomplished by placing them around the pipe and baffle sub-assembly; and the section joints are sealed by high temperature mastic, gasket, o-ring, or similar sealing material available to the artisan. The polymeric section joints may also be sealed by methods known in the art for joining polymeric materials such as fasteners, adhesives, ultrasonic welding, laser welding, or preferably vibrational welding.

Heating the muffler assembly provides sealing of the muffler assembly. Thus, heating the thermal insulating material comprising the reinforced nonwoven fabric causes expansion of the fabric to seal the muffler assembly at the housing-exhaust pipe interface. The time/temperature profile required for heating the muffler system sufficiently to seal the housing-exhaust pipe interface is dependent upon the melting point and/or softening point and the melt viscosity of the thermoplastic binder. The heating step may be performed at a temperature that is higher than the melting point of the thermoplastic binder, and preferably at least about 5 to 10° C. higher than the melting point. If the thermoplastic binder has a softening point but no melting point, preferably a temperature at least about 20° C. higher than the softening point is used. In various embodiments the heating may be performed at a temperature of 120° C., 140° C., 160° C., 180° C., 200° C. and 250° C. In various embodiments the heating time is 1 to 30 minutes.

The housing-exhaust pipe interface is considered sealed when the muffler assembly has a leak rate of 105 Liters/minute or less at 4.5 psig pressure, according to the leak test defined in the Methods section. The muffler assembly has a leak rate of less than 105 Liters/minute, preferably less than 80 Liters/minute and more preferably less than 60 Liters/minute at 4.5 psig pressure.

Heating the muffler assembly also may provide sealing or partially sealing the polymeric baffle-exhaust pipe interfaces and the baffle-polymeric housing interfaces, if present, using the same mechanism of expansion of the thermal insulating layer.

A preferred method includes use of an integral thermal insulating layer for both the housing lining and extending between the housing and exhaust pipe interface, and folding over the thermal insulating layer to provide a double layer.

The lightweight muffler assemblies of this invention are especially useful in automobiles and trucks. However, the muffler assemblies can also be used to acoustically tune the sound of the exhaust of any internal combustion engine.

The following figures illustrate various embodiments:

FIG. 1 illustrates one embodiment of the muffler assembly (1) including one exhaust pipe (2) having a plurality of perforations (3); a polymeric housing (4) supported by the exhaust pipe, the polymeric housing having a housing interior surface and at least one housing-exhaust pipe interface (7) and the polymeric housing enclosing the plurality of perforations to provide an acoustic chamber (5); and a thermal insulating layer (6) lining said housing interior surface and extending axially along the housing-exhaust pipe interface (7), wherein the thermal insulating layer seals the muffler assembly at the housing-exhaust pipe interface.

Figure 2:
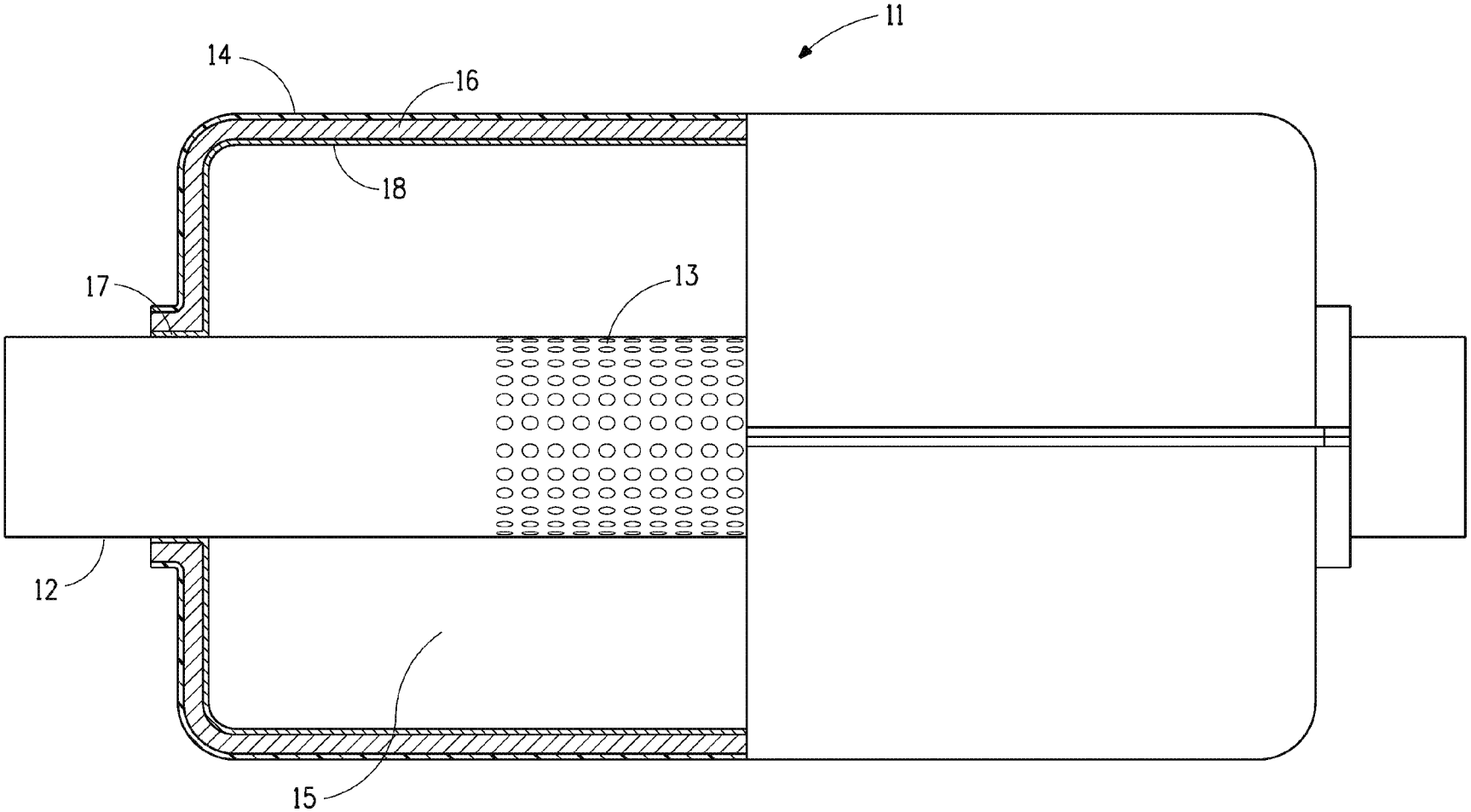
FIG. 2 is a cross-sectional view of a muffler assembly similar to FIG. 1 including a metal layer adjacent to the thermal insulating layer; the metal layer and the thermal insulating layer sealing at the interface between the polymeric housing and exhaust pipe.
Figure 3:
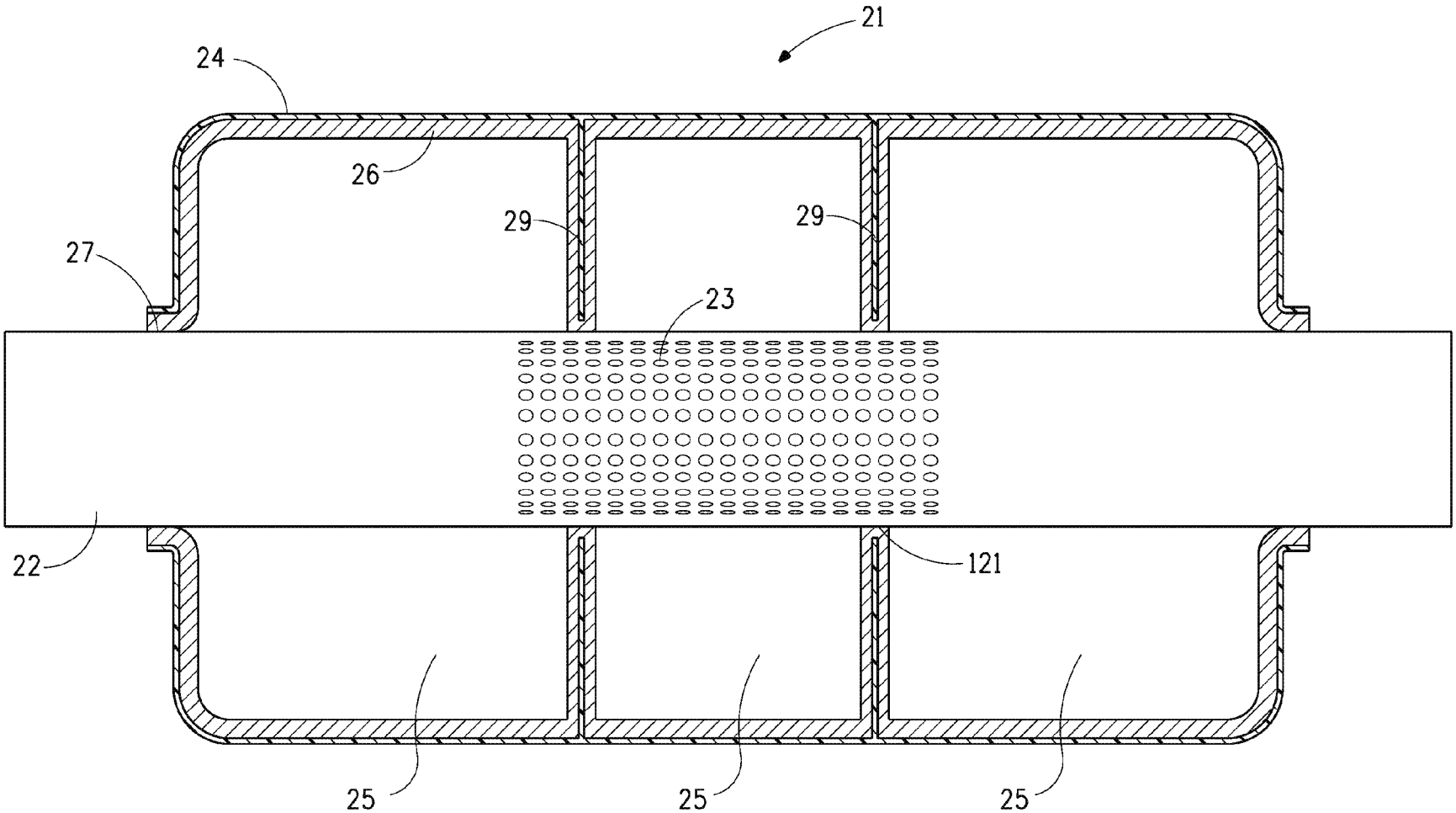
FIG. 3 is a cross-sectional view of a muffler assembly illustrating the polymeric baffles and three acoustic chambers.

FIG. 2 illustrates another embodiment (11), similar to FIG. 1, that further includes a metal layer (18) adjacent and attached to a face of the thermal insulating layer opposite the housing interior surface, wherein the thermal insulating layer (16) and metal layer (18) seals the muffler assembly at the housing-exhaust pipe interface (17), FIG. 3 illustrates one embodiment of the muffler assembly (21) including one exhaust pipe (22) having a plurality of perforations (23); a polymeric housing (24) supported by the exhaust pipe, the polymeric housing having a housing interior surface and one or more housing-exhaust pipe interface(s) (27), the polymeric housing enclosing the plurality of perforations, and the polymeric housing having two integrated polymeric baffles (29) spaced within the polymeric housing; said integrated polymeric baffles extending toward the exhaust pipe(s) to provide baffle-exhaust pipe interfaces (121); and a thermal insulating material (26) lining said housing interior surface, including the polymeric baffles, and extending axially along the housing-exhaust pipe interface (27), wherein the thermal insulating layer seals the muffler assembly at the housing-exhaust pipe interface and contacts, but not necessarily seals, the baffle-exhaust pipe interfaces to provide three acoustic chambers (25).

Figure 4:
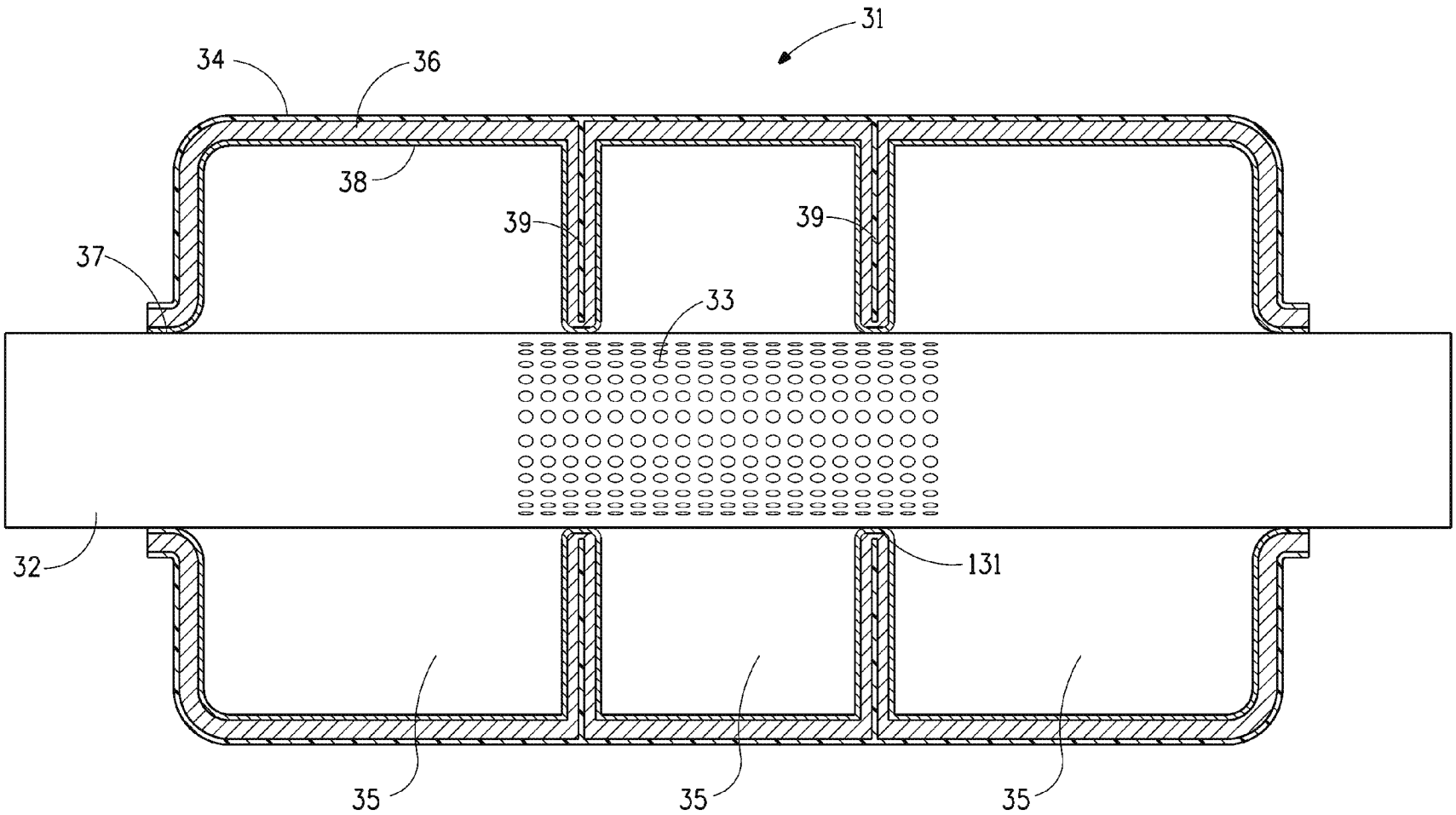
FIG. 4 is a cross-sectional view of a muffler assembly illustrating the polymeric baffles a metal layer, and three acoustic chambers.

FIG. 4 illustrates another embodiment (31), similar to FIG. 3, that further includes a metal layer (38) adjacent and attached to a face of the thermal insulating layer (36) opposite the housing interior surface, wherein the thermal insulating layer and metal foil layer seals the muffler assembly at the housing-exhaust pipe interface (37).

Figure 5:
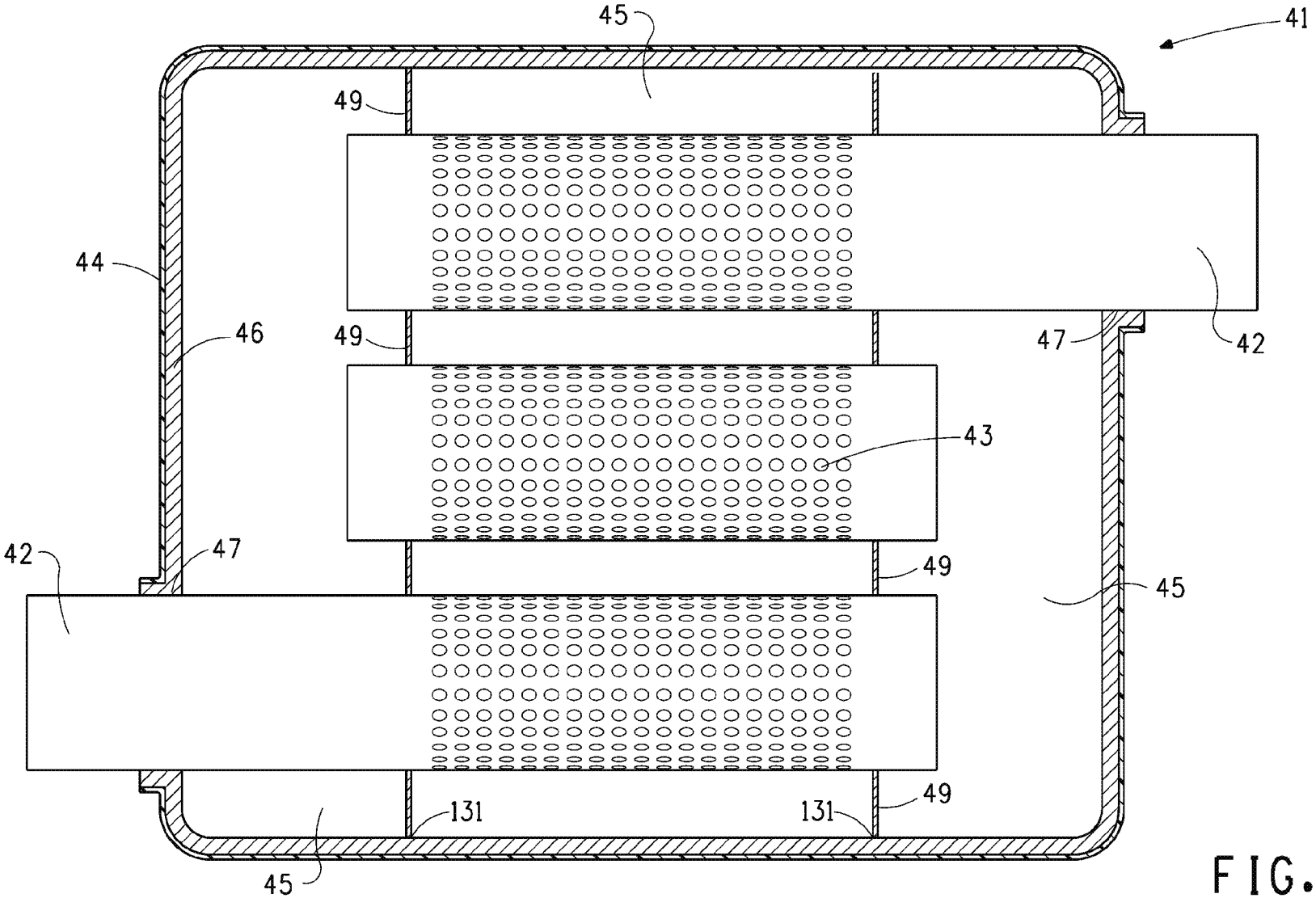
FIG. 5 is a cross-sectional view of a muffler assembly illustrating the metal baffles.

FIG. 5 illustrates one embodiment of the muffler assembly (41) including multiple exhaust pipes (42) having a plurality of perforations (43); a polymeric housing (44) supported by at least one exhaust pipe, the polymeric housing having a housing interior surface and at least one housing-exhaust pipe interface (47), the polymeric housing enclosing the plurality of perforations, and the exhaust pipes having metal baffles (49) spaced along the exhaust pipes; and extending radially to provide housing-baffle interfaces (131); and a thermal insulating layer (46) lining said housing interior surface, and extending axially along the housing-exhaust pipe interface (47), wherein the thermal insulating layer seals the muffler assembly at the housing-exhaust pipe interface to provide acoustic chambers (45). In this embodiment the housing-baffle interfaces (131) may be sealed or may not be sealed.

Figure 6:
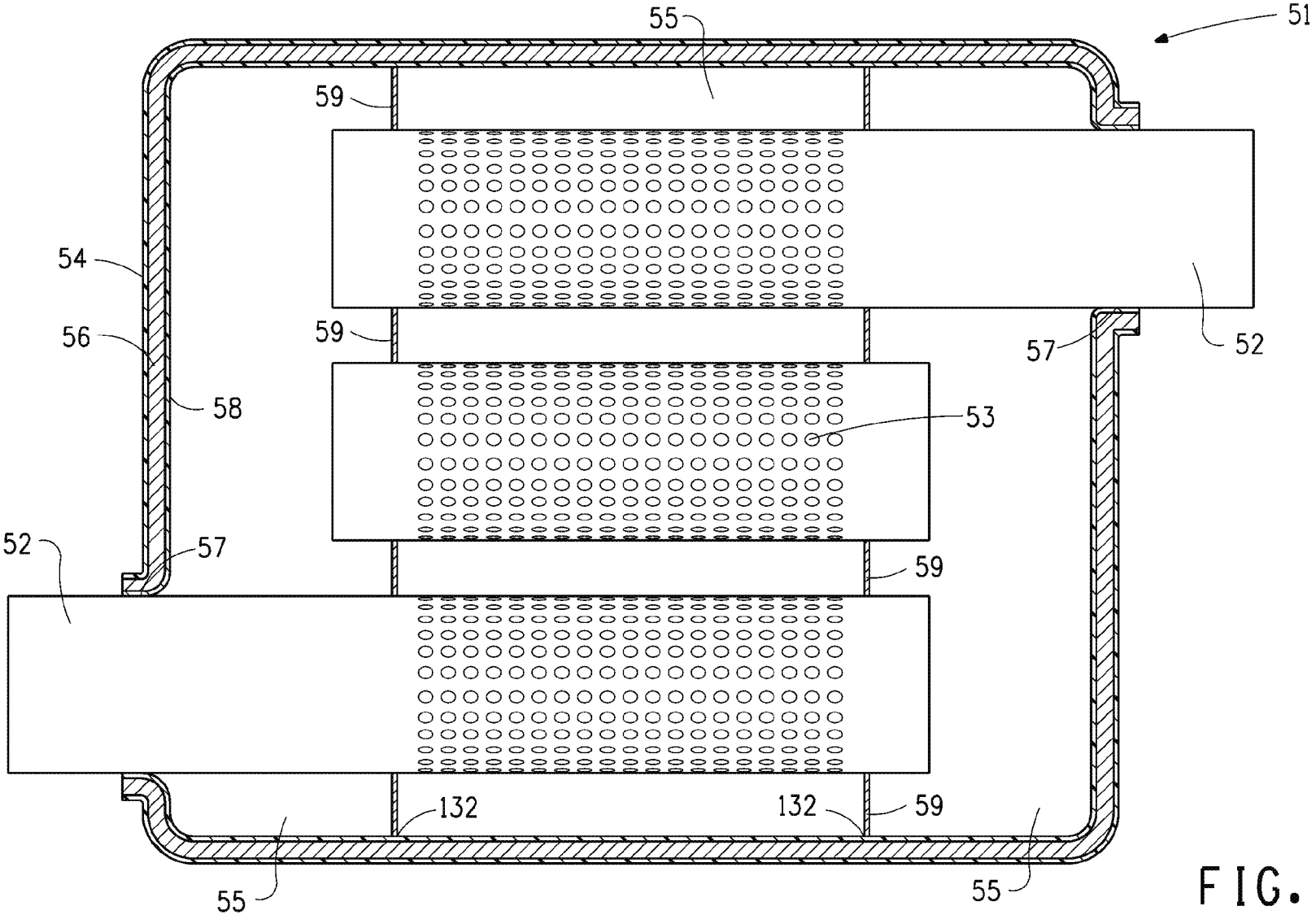
FIG. 6 is a cross-sectional view of a muffler assembly illustrating the metal baffles and a metal layer adjacent to the thermal insulating layer.

FIG. 6 illustrates another embodiment (51), similar to FIG. 5, that further includes a metal layer (58) adjacent and attached to a face of the thermal insulating layer (56) opposite the housing interior surface, wherein the thermal insulating layer and metal layer seals the muffler assembly at the housing-exhaust pipe interface (57).

Figure 7:
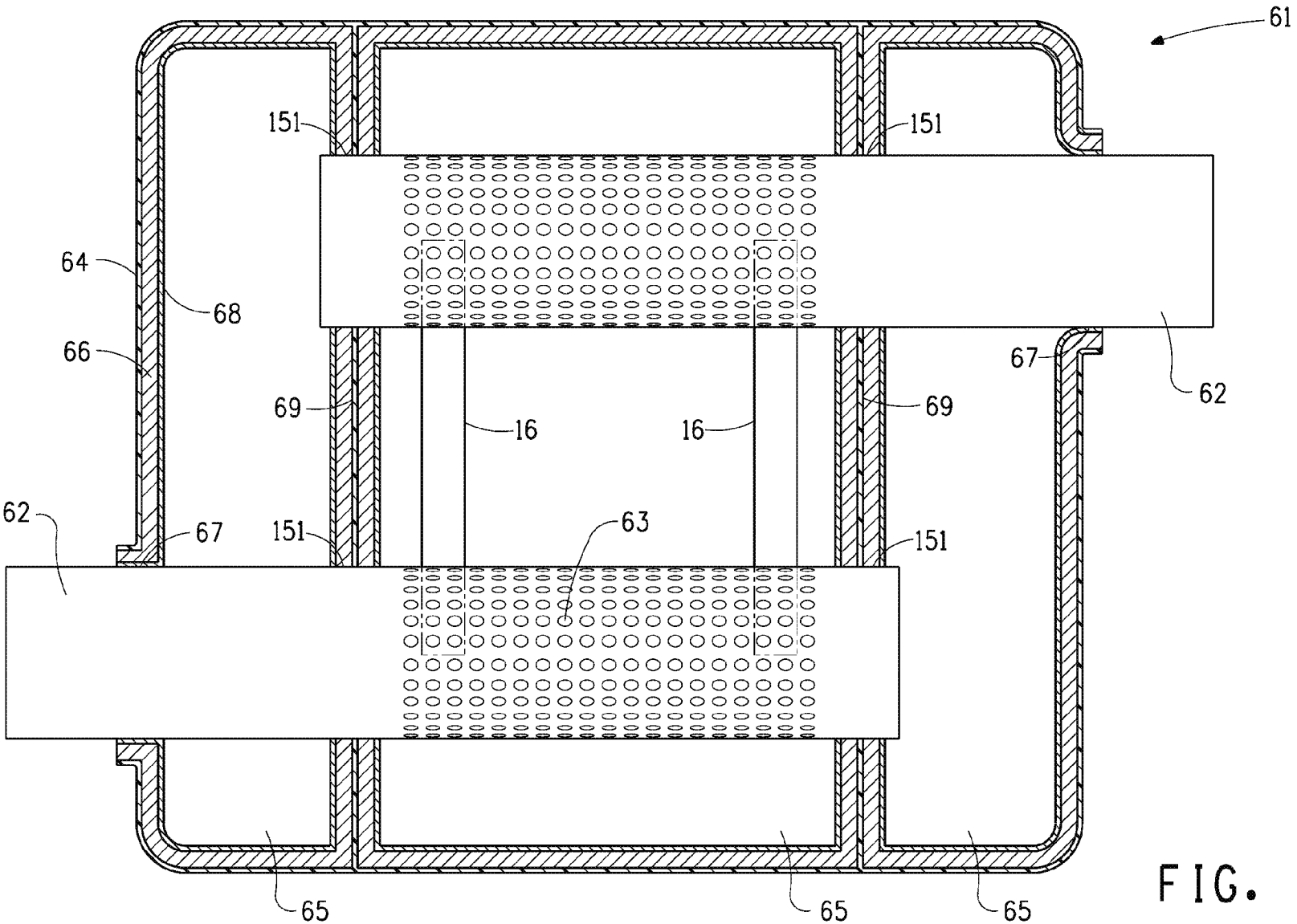
FIG. 7 is a cross-sectional view of a muffler assembly illustrating the metal braces attached to the exhaust pipes.

FIG. 7 illustrates one embodiment (61) of the muffler assembly including two exhaust pipes (62) having a plurality of perforations (63); two metal braces (141) spaced along, attached to, and connecting the two exhaust pipes, a polymeric housing (64) supported by the exhaust pipes, the polymeric housing having a housing interior surface and one or more housing-exhaust pipe interface(s) (67), the polymeric housing enclosing the plurality of perforations, and the polymeric housing having two integrated polymeric baffles (69) spaced within the polymeric housing; said integrated polymeric baffles extending to provide baffle-exhaust pipe interfaces (151); a thermal insulating material (66) lining said housing interior surface, including the polymeric baffles, and extending axially along the housing-exhaust pipe interface (67), a metal layer (68) adjacent and attached to a face of the thermal insulating layer opposite the housing interior surface, wherein the thermal insulating layer and metal foil layer seals the muffler assembly at the housing-exhaust pipe interface (67) and contacts the baffle-exhaust pipe interfaces (151) to provide three acoustic chambers (65). In one embodiment the baffle-exhaust pipe interfaces may be sealed. The metal support braces (141) provide additional stability and reduce vibration and movement of the exhaust pipes.

Figure 8:
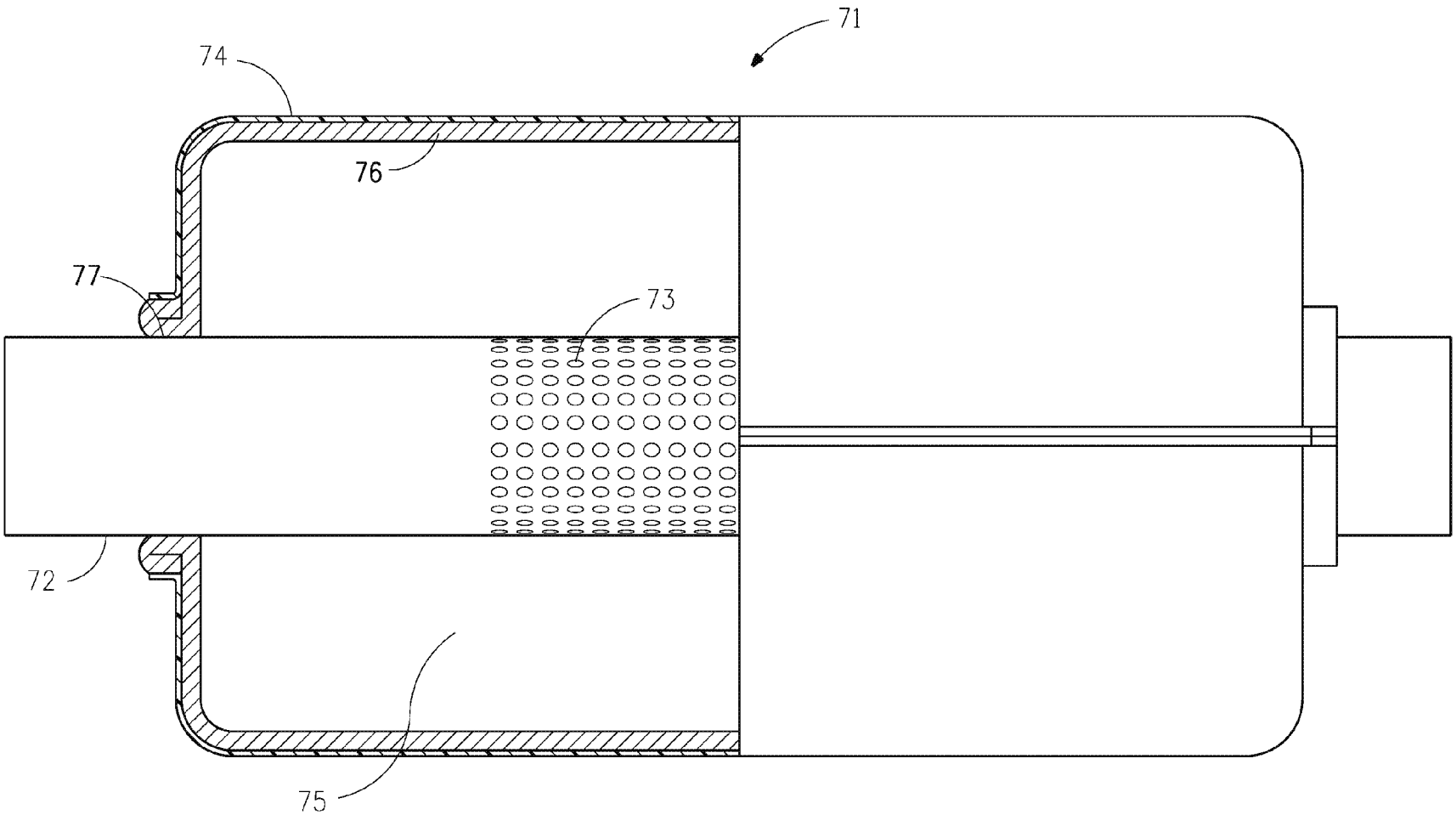
FIG. 8 is a cross-sectional view of a muffler assembly illustrating the two layers of thermal insulating layers at the housing-exhaust pipe interface.

FIG. 8 illustrates an embodiment wherein the thermal insulating layer (76) has been folded over to provide a second thermal insulating layer at the housing-exhaust pipe interface (77).

Figure 9:
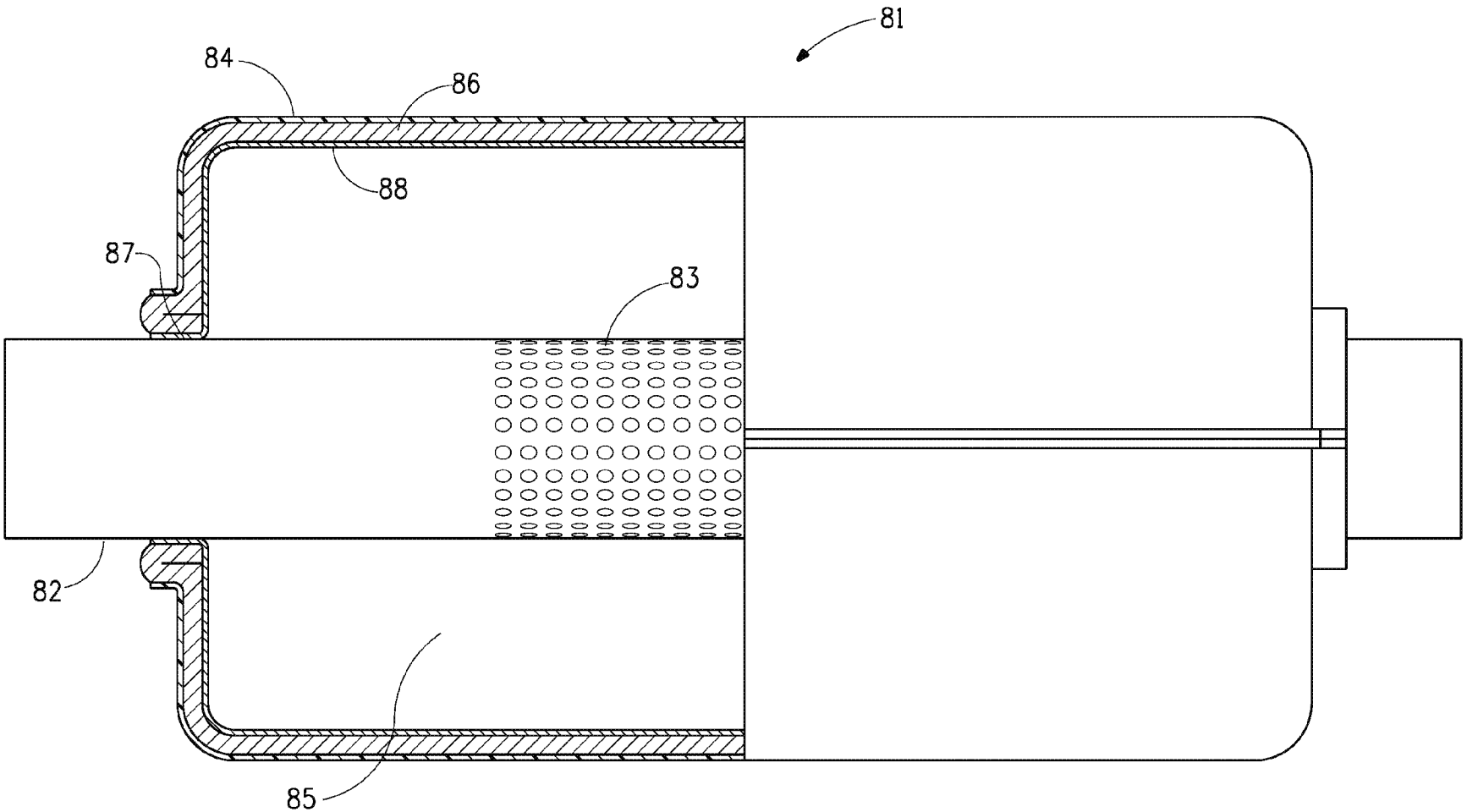
FIG. 9 is a cross-sectional view of a muffler assembly illustrating the two layers of metal layer and thermal insulating layer at the housing-exhaust pipe interface.

FIG. 9 illustrates and embodiment wherein the thermal insulating layer (86) and the metal layer (88) have been folded over to provide a second thermal insulating layer and a second metal layer at the housing-exhaust pipe interface (87) with the metal layer contacting both the housing and the exhaust pipe.

Methods

Leak Test Method

The following leak test method was used to evaluate the sealing properties of the thermal insulation material of the muffler assemblies of the invention.

To prepare the muffler assembly for testing, the outlet exhaust pipe was completely plugged or sealed with an expanding pipe plug (available from Oatey Plumbing) of a size that will completely seal the pipe of the muffler being tested. If there was a drain hole in the muffler casing, the drain hole was also to be sealed off with a rubber stopper or equivalent sealing device.

A modified expanding pipe plug was fitted on the exhaust inlet pipe. The plug was modified such that a hose nipple could be attached in a manner that allowed the perimeter of the plug to seal off the pipe, while still providing a means to allow air pressure into the muffler casing through the center of the plug.

A leak testing device was constructed for testing the assembled muffler units consisting of an adjustable air pressure regulator, a digital pressure readout display (reading from a pressure transducer), and a flow meter also utilizing a digital readout. The pressure regulator was connected to a supply of compressed atmospheric air, and plumbed to the pressure transducer. Downstream of the pressure transducer was a flow meter connected such that it measures the flow of air into the test subject. The testing device (regulator, pressure transducer and flow meter assembly) was connected to the muffler assembly via a length of hose which attaches to the aforementioned modified expanding pipe plug.

The muffler assembly was connected to the testing device as described above, and the following testing procedure was followed. The air pressure was adjusted via the regulator until the pressure in the muffler stabilized at the desired pressure reading (1.5 psig or 4.5 psig) according to the digital pressure readout. Once the desired pressure was reached and the pressure stabilized, the air flow rate was read from the flow meter digital readout. This value corresponds to the leak rate of the muffler assembly and is measured in Liters/minute. A muffler assembly of the invention passed the leak rate test if the leak rate was less than 105 liters/min, Materials Disclosed below is a method for preparing a thermal insulating layer useful in manufacturing of the muffler assembly. The thermal insulating layer is in the form of a nonwoven fabric.

Herein denier is a unit of measure for the linear mass density of fibers. It is defined as the mass in grams per 9,000 meters. The denier is based on a natural standard: a single strand of silk is one denier. A 9,000 meter strand of silk weighs one gram. The term dpf means denier per filament.

A nonwoven fabric was prepared as follows. 77.5 parts by weight 2.2 dpf, 2" cut length Type 970 KEVLAR® brand staple fiber and 22.5 parts 4 dpf, 2" cut length Type 4080 Unitika binder fiber were blended as fed from bales to three cards. Fiber webs from the three cards were collected on a transporting belt to create a fiber mat having a basis weight of approximately 3.2 oz/yd$^2$. The fiber mat was conveyed through an oven at 285° C. to melt the binder fiber. At the oven exit the sheet was compressed between two steel rolls with 0" gap, which consolidated the components into a cohesive fabric. The fabric was then cooled in this compressed state. The final fabric had a thickness of approximately 0.96 millimeter per ASTM D1777-96 Option 1.

Prophetic Example

The muffler design exemplified corresponds generally to that of FIG. 2 wherein the thermal insulation layer is the nonwoven fabric disclosed in the materials section.

Two mating polymeric housing half shells (32.8 cm×30.3 cm×7.6 cm deep) are prepared by injection molding of DuPont Zytel® HTN 54G35HSLR BK031 resin (melting point about 300° C.). The mating housing shells have semicircle depressions on the sides at both ends to receive an exhaust pipe; and male and female linear vibration weld joints, respectively, at the interfaces of the polymeric housing half shells.

A sheet of the fiber mat is cut to fit the dimensions of the interior surface of the polymeric housing half shells with exception of the area of the housing-exhaust pipe interface. A single layer of fiber mat is used. In addition, an extra flap of material is left along the mating edges of the shells of approximately one-half inch to protect the seam between the casings halves after assembly.

After lining the shells, the fiber mat is permanently attached to the shell by ultrasonic staking using a Branson Ultrasonics Corp. model PT-250 handheld ultrasonic gun fitted with a rounded staking tip. The ultrasonic gun is set to energy mode and a value of 50 joules entered for the limit. The lining is staked around the edges of the casings evenly spaced approximately 10 cm apart. Two additional stakes are included on the internal bottom area:

A sub-assembly consisting of a stainless steel exhaust pipe having a plurality of perforations, having a nominal diameter about 0.5-2 mm less than the semicircular depressions of the polymer shells for receiving the exhaust pipe was then prepared for installation into the muffler casings. The pipe is wrapped with two layers of 0.5 inch wide strips of the fiber mat such that the 2-layer fiber mat is positioned at the interfaces of the exhaust pipe and the polymeric housing shells. If necessary the semicircle portions of the polymeric shells are ground, using a handheld rotary tool, to allow for the two layer of fiber mat to be sandwiched in between the shell and mounting adapter.

The lined polymeric casings are vibrationally welded together around the pipe assembly using a Branson VW-8 Ultra Hy-Line vibration welder with tooling built specifically for the shape of the polymeric casings. The lower shell half is placed in the lower (stationary) half of the tooling, and the upper half is placed in the upper (vibrating) half of the tooling. The pipe assembly is then placed in the openings of the lower casing. The pieces are welded together using the following parameters:

Weld Amplitude: 0.070"
Weld Force: 2500 lbs
Hold Force: 2500 lbs
Melt Distance: 0.085"
Hold Time: 10 Seconds.

To seal the muffler assembly at the housing-exhaust pipe interfaces, the muffler assembly is placed in an oven preheated to 176° C. for approximately 30 minutes. The muffler assembly is removed from the oven and allowed to equilibrate back to room temperature.

The muffler assembly passes the leak rate test, having a maximum leak rate of less than 105 liters/min.

Prophetic Example

The muffler design tested is similar to that of FIG. 2 wherein a thermal insulation layer is the nonwoven fabric disclosed in the materials section and the metal layer is aluminum foil and both layers are present and seal the housing-exhaust pipe interface.

We claim:

1. A reflective muffler assembly comprising:

a) one or more exhaust pipe(s), at least one of the exhaust pipe(s) having a plurality of perforations;

b) a polymeric housing carried by at least one of the exhaust pipe(s), the polymeric housing having a housing interior surface and at least one housing-exhaust pipe interface and the polymeric housing enclosing the plurality of perforations to provide one or more acoustic chamber(s); and c) a thermal insulating layer lining said housing interior surface and extending between the housing and exhaust pipe at the at least one housing-exhaust pipe interface; wherein the thermal insulating layer comprises a nonwoven fabric comprising crimped, heat-resistant organic fibers compressed thereon, the fibers held in a compressed state by a thermoplastic binder;

wherein when the fabric is exposed to heat, the fabric increases in thickness to seal the reflective muffler assembly at the housing-exhaust pipe interface and provides thermal insulation to the polymeric housing.

2. The muffler assembly of claim 1 further comprising one or more internal polymeric baffle(s) integrally formed and spaced within the polymeric housing and extending toward the exhaust pipe(s) to provide at least one baffle-exhaust pipe interface, the one or more internal polymeric baffle(s) providing two or more acoustic chambers within the muffler assembly.

3. The muffler assembly of claim 1 further comprising one or more internal metal baffle(s) connected to and spaced along the exhaust pipe(s) and extending toward the polymeric housing to provide at least one baffle-polymeric housing interface, the one or more internal metal baffle(s) providing two or more acoustic chambers within the muffler assembly.

4. The muffler assembly of claim 1 comprising at least two exhaust pipes and two or more metal braces spaced along, attached to, and connecting the at least two exhaust pipes.

5. The muffler assembly of claim 1 further comprising a metal layer adjacent to a face of the thermal insulating layer opposite the housing interior surface.

6. The muffler assembly of claim 5 wherein the metal layer and the thermal insulating layer extend between the housing and exhaust pipe at the housing-exhaust pipe interface wherein the metal layer and the thermal insulating layer seal the muffler assembly at the housing-exhaust pipe interface.

7. The muffler assembly of claim 1 wherein the thermal insulating layer extending between the housing and exhaust pipe at the at least one housing-exhaust pipe interface comprises two or more thermal insulating layers.

8. A process for making a reflective polymeric muffler assembly comprising the steps of:

i) assembling one or more exhaust pipe(s), at least one of the exhaust pipe(s) having a plurality of perforations to form a pipe sub-assembly;

ii) enclosing the pipe sub-assembly with two or more polymeric housing sections carried by at least one of the exhaust pipe(s), the polymeric housing sections having a housing interior surface and at least one housing-exhaust pipe interface and the polymeric housing sections enclosing the plurality of perforations to provide one or more acoustic chamber(s); wherein a thermal insulating layer lines said housing interior surface and extends between the housing and exhaust pipe at the at least one housing-exhaust pipe interface, and wherein the thermal insulating layer comprises a nonwoven fabric comprising crimped, heat-resistant organic fibers compressed thereon, the fibers held in a compressed state by a thermoplastic binder;

iii) adhering or attaching the polymeric housing sections together to form a polymeric muffler assembly;

iv) heating the polymeric muffler assembly sufficiently such that the nonwoven fabric increases in thickness to seal the reflective polymeric muffler assembly at the housing-exhaust pipe interface.

9. The process of claim 8 wherein the polymeric muffler housing sections are attached in step (iii) by fasteners, adhesives, or a polymeric welding process.

10. The process of claim 8 wherein the polymeric muffler housing sections are attached in step (iii) by polymeric welding process selected from the group consisting of ultrasonic welding, laser welding, or vibrational welding.

11. The process of claim 8, further comprising placing a metal layer adjacent to a face of the thermal insulating layer opposite the housing interior surface.

12. The process of claim 11 wherein the metal layer and the thermal insulating layer extend between the housing and exhaust pipe at the housing-exhaust pipe interface wherein the metal layer and the thermal insulating layer seal the muffler assembly at the housing-exhaust pipe interface.

* * * * *